US010508648B2

(12) United States Patent
Gehrke et al.

(10) Patent No.: US 10,508,648 B2
(45) Date of Patent: Dec. 17, 2019

(54) AUTOMATED CROSS-PHASE PUMP AND CONTROLLER

(71) Applicant: Trebor International, West Jordan, UT (US)

(72) Inventors: Cody Lee Gehrke, South Jordan, UT (US); Cory Dennis Shorr, South Jordan, UT (US); Kelly E. Davis, American Fork, UT (US)

(73) Assignee: TREBOR INTERNATIONAL, West Jordan, UT (US)

( * ) Notice: Subject to any disclaimer, the term of this patent is extended or adjusted under 35 U.S.C. 154(b) by 372 days.

(21) Appl. No.: 15/198,551

(22) Filed: Jun. 30, 2016

(65) Prior Publication Data

US 2017/0009763 A1 Jan. 12, 2017

Related U.S. Application Data

(60) Provisional application No. 62/190,599, filed on Jul. 9, 2015.

(51) Int. Cl.
*F04B 49/06* (2006.01)

(52) U.S. Cl.
CPC ..... *F04B 49/065* (2013.01)

(58) Field of Classification Search
CPC ..... F04B 13/00; F04B 23/06; F04B 43/06
USPC ..... 417/413.1
See application file for complete search history.

(56) References Cited

U.S. PATENT DOCUMENTS 6,742,993 B2 * 6/2004 Savard ..... F04B 7/0266 222/61
7,942,647 B2 * 5/2011 Okumura ..... F04B 43/06 417/395
8,087,429 B2 * 1/2012 Cedrone ..... F04B 13/00 137/884

* cited by examiner

*Primary Examiner* — Patrick Hamo
(74) *Attorney, Agent, or Firm* — Workman Nydegger

(57) ABSTRACT

In one example, a fluid system is provided that includes an air-operated fluid pump, a control air system operably connected with the fluid pump, and a pump controller operably connected with one or more components of the control air system. The pump controller is configured to automatically control the operation of the air-operated fluid pump by way of the control air system. The fluid pump parameters automatically controlled by the pump controller can include a discharge flow rate of the fluid pump, a discharge pressure of the fluid pump, and/or a pulsation value associated with the discharge of the fluid pump.

18 Claims, 5 Drawing Sheets

AUTOMATED CROSS-PHASE PUMP AND CONTROLLER

RELATED APPLICATIONS

This application hereby claims the benefit of, and priority to, U.S. Patent Application Ser. No. 62/190,599, entitled AUTOMATED CROSS-PHASE PUMP AND CONTROLLER, and filed Jul. 9, 2015. The aforementioned application is incorporated herein in its entirety by this reference.

FIELD OF THE INVENTION

The present disclosure is generally concerned with fluid systems and fluid system components. More specifically, the disclosed embodiments concern fluid system components including diaphragm pumps and associated pump controllers.

BACKGROUND

Diaphragm pumps are well suited for a variety of applications, including semiconductor manufacturing processes for example. One of the characteristics of many diaphragm pumps is that they produce a pulsating discharge. While some pulsing of the discharge flow is unavoidable, excessive pulsing can be problematic. In recognition of this efforts have been made to adjust various pump parameters in an attempt to reduce pulsing of the discharge flow. Such parameters include air supply pressure, vacuum pressure, pump cycle time, phase overlap, and pump head air supply orifice size.

While satisfactory pump operation might be attained through adjustment of such parameters, typical adjustment processes are often time-consuming and do not always produce good results. This is due in large part to the fact that adjustment of such parameters is typically performed manually. Thus, a trial and error process is required in order to attain acceptable pump performance. Moreover, pump control systems that take these parameters into account are typically open loop systems. Because no pump performance feedback is provided to the pump control system, continuous monitoring is required, and manual adjustments to the parameters may be required quite often.

In light of problems and shortcomings such as those noted above, it would be useful to be able to avoid manual adjustment processes for pump parameters. It would also be useful to be able to avoid the need for a trial and error approach to achieving satisfactory pump performance. Finally, it would be useful to be able to use pump performance feedback to automatically adjust the pump performance.

ASPECTS OF SOME EXAMPLE EMBODIMENTS

It should be noted that the embodiments disclosed herein do not constitute an exhaustive summary of all possible embodiments, nor does this brief summary constitute an exhaustive list of all aspects of any particular embodiment (s). Rather, this brief summary simply presents selected aspects of some example embodiments. It should further be noted that nothing herein should be construed as constituting an essential or indispensable element of any invention or embodiment. Rather, various aspects of the disclosed embodiments may be combined in a variety of ways so as to define yet further embodiments. Such further embodiments are considered as being within the scope of this disclosure. As well, none of the embodiments embraced within the scope of this disclosure should be construed as resolving, or being limited to the resolution of, any particular problem(s). Nor should such embodiments be construed to implement, or be limited to implementation of, any particular technical effect(s) or solution(s).

Disclosed embodiments are generally concerned with fluid systems and associated components and control systems. Embodiments within the scope of this disclosure may include any one or more of the following elements, and features of elements, in any combination: a diaphragm pump; an air-operated diaphragm pump; a diaphragm pump including one or more plastic components; a diaphragm pump including one or more polytetrafluoroethylene (PTFE) components, such as a pump body and/or a pump head; a diaphragm pump controller that automatically controls one or more parameters of a pump control system to achieve a specified pump flow rate and pulsation performance; a pump control system that uses air or another gas as an operating fluid to control pump operation; a diaphragm pump controller operable to automatically control any one or more of various parameters of a pump control system that uses air as an operating fluid, including air supply pressure, vacuum pressure, cycle time, phase overlap, and pump head air supply orifice size; a diaphragm pump controller that implements a closed loop control system; a diaphragm pump controller directly mounted to a diaphragm pump, or integrated into the diaphragm pump; a PTFE diaphragm; a diaphragm pump that includes one or more machined PTFE diaphragms; a diaphragm pump that includes a free-floating diaphragm; a diaphragm pump that includes a pinned free-floating diaphragm and V-groove seal; and, a diaphragm pump operable at pressures up to about 100 psi and temperatures up to about 180 C.

BRIEF DESCRIPTION OF THE DRAWINGS

The appended drawings contain figures of some example embodiments to further clarify various aspects of the present disclosure. It will be appreciated that these drawings depict only some embodiments of the disclosure and are not intended to limit its scope in any way. The disclosure will be described and explained with additional specificity and detail through the use of the accompanying drawings in which.

DETAILED DESCRIPTION OF SOME EXAMPLE EMBODIMENTS

Figure 1:
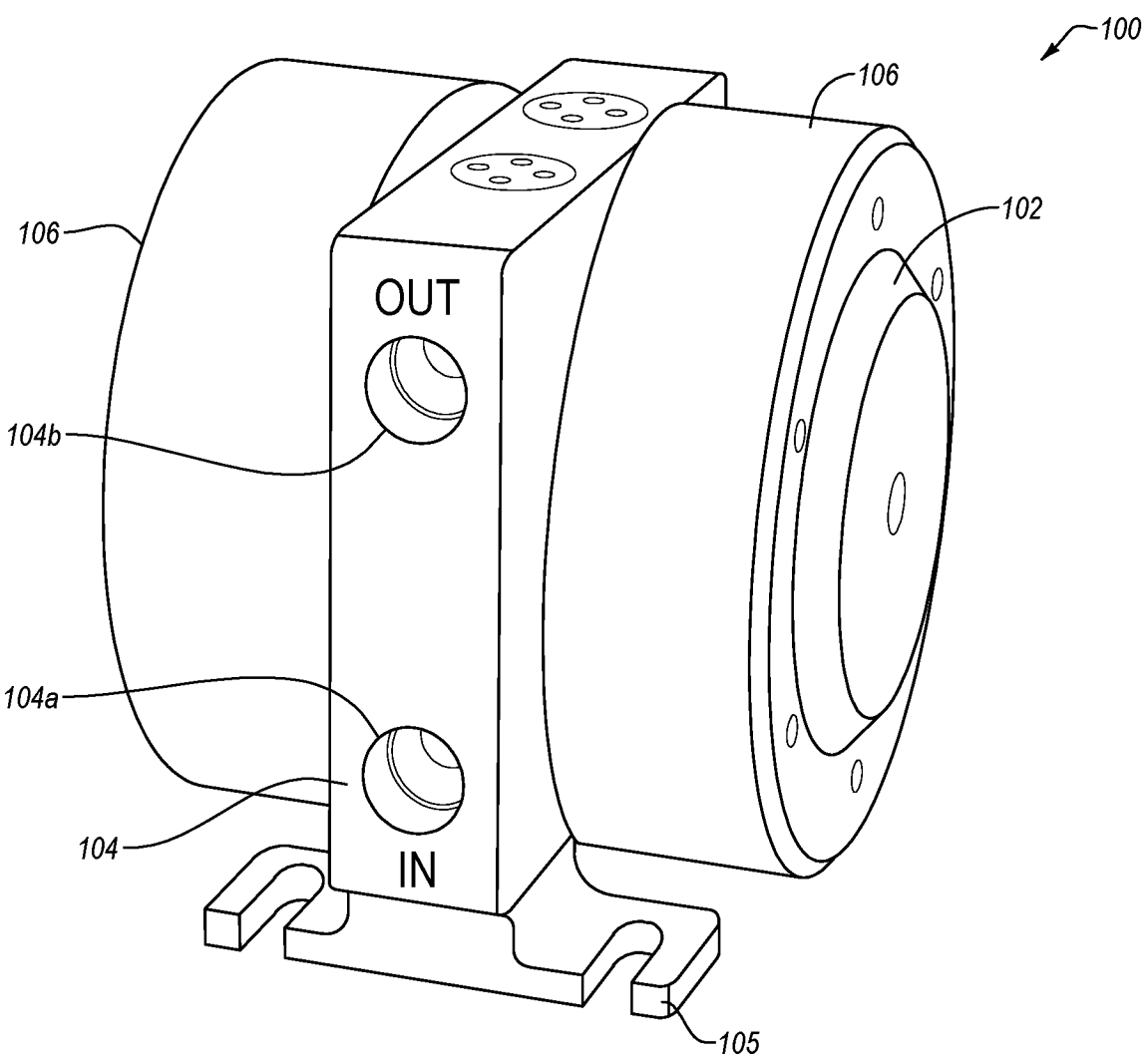
FIG. 1 is a perspective view of an example fluid pump that can be used in at least some embodiments.

The present disclosure is generally concerned with fluid systems and fluid system components. More specifically, the disclosed embodiments concern fluid system components including diaphragm pumps and associated pump control systems and pump controllers. In one particular example, a pump controller is provided that facilitates closed loop control of a pump, such as a diaphragm pump for example, by automatically controlling one or more parameters of a pump control system that uses air and/or one or more other gases, or other compressible fluids, as an operating fluid. Examples of such parameters that can be automatically controlled include, but are not limited to, air supply pressure such as clean dry air (CDA) pressure, vacuum pressure, cycle time of a fluid pump between a suction operation and a discharge operation, phase overlap, and pump head air supply orifice size, such as the size of the opening in a flow control valve such as a needle valve for example.

A. General Aspects of Some Example Embodiments

In general, fluid system components disclosed herein may be used in a variety of different applications, and may be particularly useful in fluid systems for semiconductor manufacturing processes, although the scope of the invention is not limited to such applications. Such fluid systems may employ, for example, deionized (DI) water, corrosive agents and materials including but not limited to acids and bases, gases, other fluids, and combinations of any of the foregoing. Such fluids may be hot, highly pressurized, reactive, and/or pure fluids.

The temperatures of fluids employed in such systems, such as acids for example, may be anywhere in the range of about 1 degree C. to about 180 degrees C., or in any sub-range falling within that range including, for example, about 100 degrees C. to about 180 degrees C. These temperatures are provided by way of example, and in some instances may be even higher than about 180 degrees C. For example, some systems may employ process fluids that may reach temperatures as high as about 200 degrees C. to about 220 degrees C., or higher. Note that as used herein, "fluid" embraces compressible fluids such as gases, incompressible fluids such as liquids, combinations of gases and liquids, and combinations of one or more gases and/or one or more liquids with solids.

The fluid system components disclosed herein may be constructed with a variety of components and materials including, but not limited to, non-reactive and substantially non-reactive materials, non-metallic and substantially non-metallic materials, rubber, plastics such as polymers, and composites. It should be noted that non-reactive and substantially non-reactive materials embrace a variety of materials, including both metals, such as stainless steel for example, as well as non-metallic materials, such as plastics for example. Examples of the aforementioned polymers may include perfluoroalkoxy (PFA) and polytetrafluoroethylene (PTFE), which can be machined or otherwise formed into various components, such as pump bodies, pump heads, and diaphragms for example. Fluoroelastomers (FKM), and perfluoroelastomers (FFKM) may also be employed. These materials may or may not be virgin materials.

In certain applications, metals such as steel including stainless steel, copper, titanium, brass, nickel, aluminum, and alloys and combinations of any of the foregoing metals, may be used. Examples of such alloys include copper-nickel alloys (CNA), and nickel-copper alloys (NCA).

B. Aspects of Some Example Fluid Pumps

In general, embodiments of the invention can be employed in connection with any of a variety of different pumps, such as diaphragm pumps. One particular example of a diaphragm pump with which embodiments of the invention can be employed is the 'Punts CP' diaphragm pump manufactured by Trebor (A Unit of IDEX Corporation). Details concerning the structure and operation of the 'Punts CP' pump are disclosed in Appendix 1 to the application noted in the 'Related Applications' section hereof.

Figure 2:
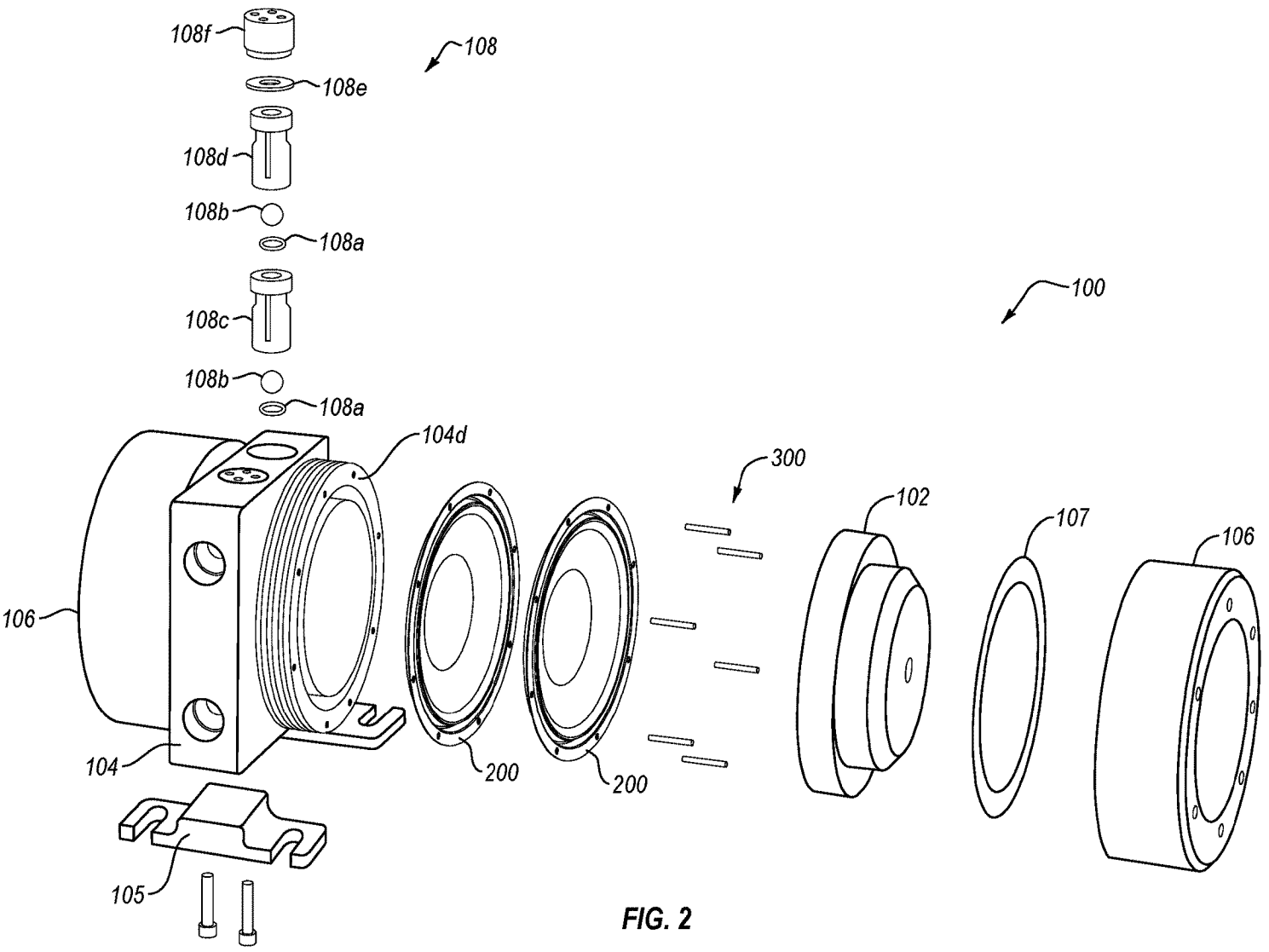
FIG. 2 is an exploded view of the example fluid pump of FIG. 1.

With particular reference now to FIGS. 1 and 2, a brief overview is provided concerning an example fluid system component that includes a diaphragm. More specifically, FIG. 1 discloses an example fluid pump 100 having a pump head 102 which may be connected, permanently or removably, to a pump body 104 that may include a fluid inlet 104*a* and a fluid outlet 104*b*. Thus, the fluid inlet 104*a* is on the suction side of the fluid pump 100, while the fluid outlet 104*b* is on the discharge side of the fluid pump 100. The fluid pump 100 may include a pump base 105 which supports the pump body 104 and pump heads 102, and to which the pump body 104 is permanently, or removably, attached.

With brief reference to FIG. 3, and as discussed in more detail below, some embodiments may include one or more union nuts 106 having threads configured to releasably engage corresponding threads of the pump body 104. The union nuts 106 may be employed to removably secure the pump head 102 to the pump body 104, and a slip ring 107, which can be made of a low-friction plastic such as PTFE for example, can be provided to reduce friction between the union nut 106 and pump head 102, and thereby enable a relatively tight diaphragm 200 seal. It should be noted that while the Figures indicate only a single pump head 102, some embodiments of a fluid pump include two pump heads, such as pump head 102, one attached to either side of a pump body such as pump body 104. The two pump heads 102 may be similar, or substantially identical, to each other in terms of construction and/or operation. Among other things, the pump heads 102 serve to seal the fluid chamber and thus enable air operation of the fluid pump 100.

Figure 3:
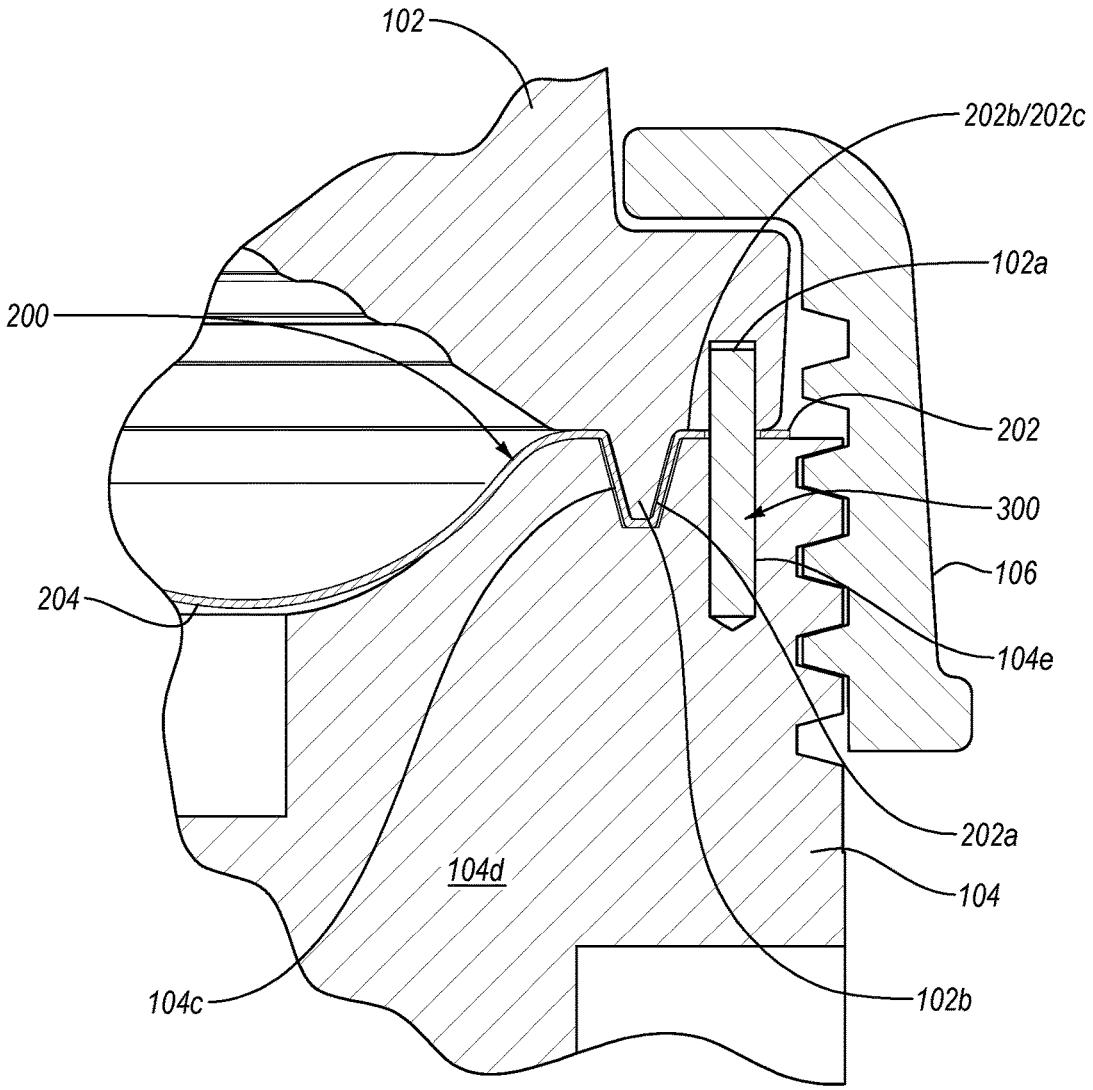
FIG. 3 discloses aspects of an example diaphragm and retention system.

As indicated in FIGS. 2 and 3, one or more diaphragms 200 may be positioned between the pump head 102 and the pump body 104. Some embodiments of a pump, such as a pump that includes multiple pump heads, may include multiple diaphragms. A plurality of retaining elements 300, such as polypropylene (PP) pins for example, may be provided that aid in retention of the diaphragm 200 in a desired position and orientation. The retaining elements 300 can also help to prevent the pump head 102 from turning during installation. As further indicated in the Figures, the pump head 102 may define a plurality of recesses 102*a*, each of which is configured to receive a portion of a retaining element 300, as discussed in more detail below. Among other things, the retaining elements 300 may help to ensure that the diaphragm 200 does not move out of position relative to the pump head 102 and the pump body 104 during operation of the fluid pump 100, since withdrawal of the diaphragm 200 from its sealing position between the pump head 102 and pump body 104 could result in leakage of the process fluid and/or operating fluid, as well as contamination of the process fluid.

The diaphragm(s) 200 can be any suitable type. Example diaphragm configurations include, but are not limited to, flat, blousing, pillow, trampoline, convolute, shallow draw, dish, "pie pan," drop center, offset convolute, deep draw, "top hat," double taper deep draw, bellows, and double bellows. When properly positioned and secured between the pump head 102 and pump body 104, the diaphragm 200 not only enables the pumping of a process fluid, but also maintains isolation between a process fluid and an operating fluid, discussed in more detail below.

With continuing attention to FIG. 2, the example fluid pump 100 may include one or more flow check assemblies 108, one of which can be placed in a fluid path that includes the fluid inlet 104*a*, and another of which can be placed in a fluid path that includes the fluid outlet 104*b*. In general, the flow check assembly 108 serves to limit fluid flow to a single direction in a fluid path. In the illustrated example, the flow check assembly 108 includes a sealing element 108*a*, such as an O-ring, that seals the rest of the flow check assembly 108 with respect to the pump body 104. A check ball 108*b*, which can be made of plastic for example and resides in a lower check ball cage 108*c*, seals against the sealing element 108*a* and, in this example, permits flow into, but not out of, the pump body 104. A further sealing element 108*a* is provided that seals against the top of the lower check ball cage 108*c*, and an additional check ball 108*b* is provided that seals against the further sealing element 108*a* to permit flow out of, but not into, the pump body 104. An upper check ball cage 108*d* is provided within which the additional check ball 108*b* resides. A gasket 108*e* positioned on top of the upper check ball cage 108*d* cooperates with a check cap 108*f* to seal the fluid path.

With regard now to some general aspects of the operation of the fluid pump 100, pressurized operating fluid, such as air and/or other gases for example, may be introduced into the fluid pump 100 so as to contact one side of the diaphragm 200, causing a corresponding displacement of the diaphragm 200. In some example embodiments, the diaphragm 200 may be in contact with a process fluid such that the process fluid is pumped by the motion of the diaphragm 200 that is induced by the pressurized operating fluid acting on the diaphragm. In other example embodiments, the diaphragm 200 may be configured to cause, either directly or indirectly, the deflection of another diaphragm (not shown) by virtue of a reciprocating shaft and/or other mechanism positioned between the diaphragms. In either example however, the pumping of a process fluid is effected by displacement of one or more diaphragms that are acted upon, either directly or indirectly, by a pressurized operating fluid.

Directing more particular attention now to FIGS. 1-3, further details are provided concerning an example fluid pump and components. With reference now to the example fluid pump 100, the pump head 102 and/or the pump body 104 may be constructed from any suitable non-reactive, or substantially non-reactive, material(s) such as PTFE or PFA, for example. Such materials may be machined, molded, or otherwise formed. More generally, the materials for the pump head 102 and pump body 104 may be selected for compatibility with the operating fluids and operating conditions with which the fluid pump 100 is expected to be employed. Other examples of materials that may be used in the construction of the pump head 102 and/or pump body 104 are disclosed elsewhere herein. In some embodiments, the pump head 102 is formed of a single piece of material.

Finally, the pump head 102 and pump body 104 may each include complementary structure(s) that cooperate with each other to aid in the retention of the diaphragm. More particularly, a portion of the diaphragm 200 may be interposed between the respective complementary structures, and the respective complementary structures may be configured so that when they are engaged with each other, they tend to resist, or prevent, withdrawal of the diaphragm from between the pump head 102 and the pump body 104 (see, e.g., FIG. 3).

With reference now to the particular example disclosed in the Figures, and particularly FIGS. 1 and 2, one or both pump heads 102 may include an annular V-shaped ridge 102*b* configured to interface with a corresponding V-shaped groove 104*c* of the pump body 104. As noted herein, these respective complementary structures of the pump head 102 and the pump body 104 may aid in the retention of the diaphragm 200 (see, e.g., FIG. 3). In the example of FIG. 3, the complementary structure 102*b* extends around a substantial portion, or all of, a diameter of a portion of the pump head 102 and has a substantially V-shaped cross section. Other cross-sectional shapes may be alternatively employed however. As well, while the example pump head 102 includes a single complementary structure, other embodiments of a pump head may include multiple complementary structures, each configured to interface with a respective complementary structure of pump body.

The engagement of the respective complementary structures with each other, with the diaphragm positioned between the complementary structures, may be referred to herein as the pump seal as it is those complementary structures that cooperate with the diaphragm to substantially prevent leakage of process and/or operating fluid from the interface between the pump head 102 and the pump body 104.

With continued reference to the Figures, particularly FIG. 2, the diaphragm 200 is positioned between the pump head 102 and the pump body 104. Similar to the pump head 102 and pump body 104, the diaphragm 200 may be substantially constructed as a single piece of material from any suitable non-reactive, or substantially non-reactive, material(s) such as PTFE or PFA, for example. Depending upon considerations such as pump life, operating fluid type, pressure, and temperature, various other materials such as those disclosed herein may alternatively be employed in the construction of the diaphragm 200. The diaphragm 200 may or may not be substantially circular in shape. As well, the diaphragm 200 may be flexible, and the degree of flexibility of the diaphragm 200 may vary from one embodiment to another, depending upon considerations such as the operating conditions to which the diaphragm 200 is expected to be exposed.

The diaphragm 200 may include an outer portion 202 and an inner portion 204. In general, the outer portion 202 may facilitate the retention of the diaphragm 200 in a desired position and orientation, while the inner portion 204 of the diaphragm 200 may facilitate the pumping of a process fluid, as disclosed elsewhere herein. The outer portion 202 may include a grooved portion 202*a* configured to receive a structure of the pump head 102, such as the complementary structure 102*b*.

Additionally, the outer portion 202 may include a rim portion 202*b*. As indicated in the Figures, one embodiment of the diaphragm 200 includes a relatively flat rim portion 202*b*. The rim portion 202*b* may include a plurality of openings 202*c*, each of which may be configured to be substantially aligned with a corresponding recess 102*a* when the diaphragm is installed between the pump head 102 and the pump body 104. The openings 202*c* may be formed when the diaphragm 200 is manufactured, or the openings 202*c* may be formed by the retaining elements 300 when the pump head 102, pump body 104 and diaphragm 200 are assembled together. As best illustrated in FIG. 3, when the fluid pump 100 is assembled, each of the retaining elements 300 extends through a corresponding opening 202*c* in the diaphragm 200. In some embodiments, the openings 202*c* may be reinforced, such as with PFA or PTFE rings or sleeves, for example. The reinforcements may be made of other materials as well.

With continued reference to the Figures, further details are now provided concerning the example pump body 104. Similar to the pump head 102, the pump body 104 may, in some embodiments, be formed of a single piece of material.

As indicated in the Figures, the pump body 104 may include a pump head mount 104*d* that is generally circular in shape. The pump head mount 104*d* may include external threads configured to releasably engage corresponding threads of the union nut 106 (see FIG. 3). The pump head mount 104*d* may include a plurality of recesses 104*e*, whose characteristics may be similar, if not identical, to those of the recesses 102*a* defined by the pump head 102. Correspondingly, the disclosure herein concerning the recesses 102*a* applies equally to the recesses 104*e*. As indicated in the Figures, each of the recesses 104*e* is configured to receive a portion of a retaining element 300. As best illustrated in FIG. 3, the recesses 102*a* and 104*e* are located outside the pump seal. In other embodiments however, the pump seal may be located outside the recesses 102*a* and 104*e*.

C. Aspects of Some Example Control Systems

Figure 4:
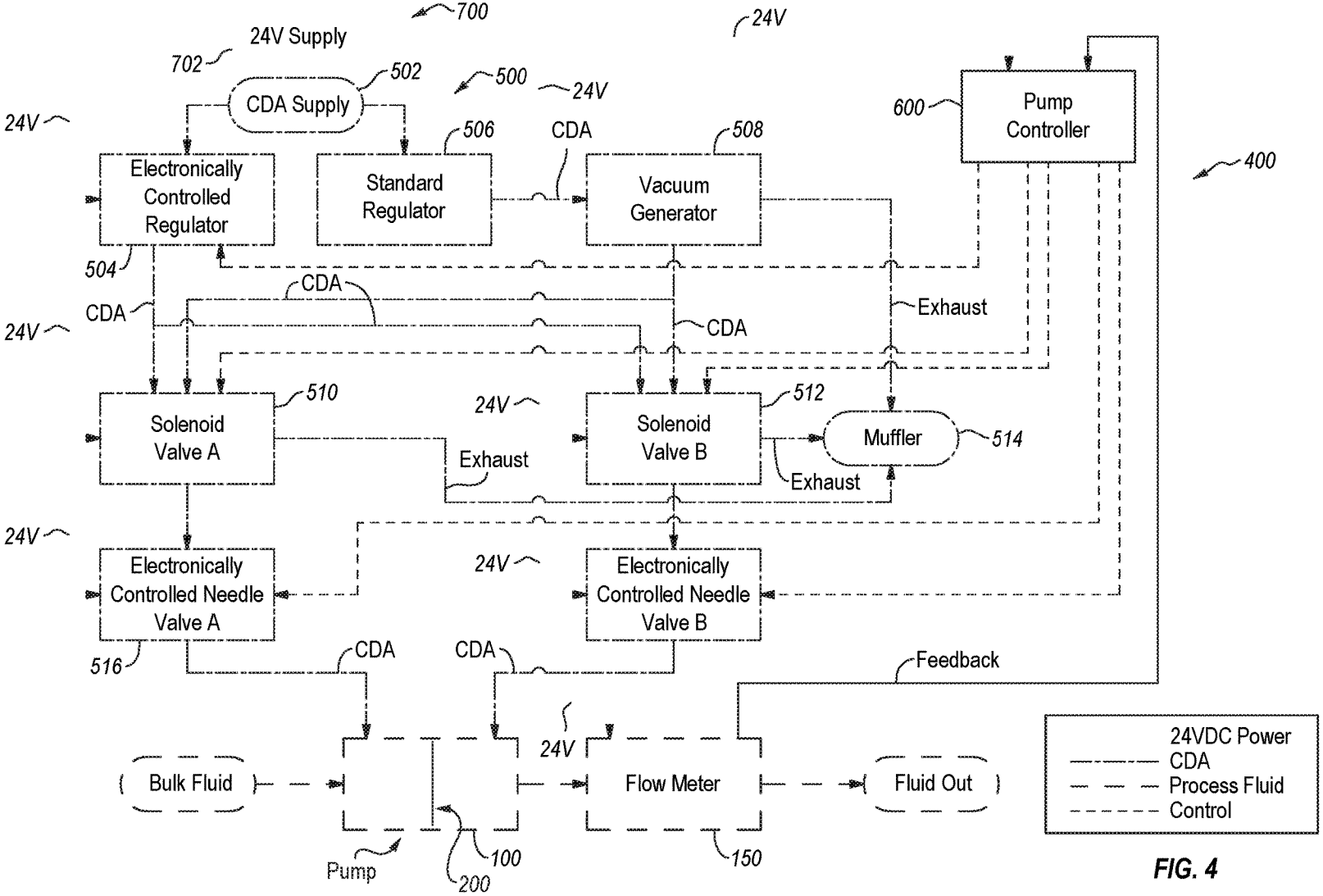
FIG. 4 is a diagram of an example pump control system.

With attention now to FIG. 4, details are provided concerning control systems for fluid pumps, such as air-operated diaphragm pumps for example. One example of such a control system is denoted generally at 400. As indicated, the control system 400 may operate in connection with one or more fluid pumps, such as the fluid pump 100, examples of which are disclosed herein. A differential pressure measurement device 150, which may be an element of the control system 400, can be provided for use in conjunction with the control system 400. Any of a variety of differential pressure measurement device(s) can be used. Some examples of such differential pressure measurement devices include, but are not limited to, flow meters, orifice plates, flow nozzles, laminar flow elements, low-loss flow tubes, segmental wedges, V-cones, and venturi tubes. In at least some embodiments, a differential pressure measurement device uses one or more pressure transducers to sense pressure and convert the sensed pressure into a signal that can be transmitted by the transducer to another component, such as a pump controller for example. In brief, a process fluid may be provided to a suction side of the fluid pump 100, exit a discharge side of the fluid pump 100, and then monitored by the differential pressure measurement device 150.

The control system 400 may include, or operate in connection with, a variety of systems. In the example of FIG. 4, a control air system 500 is provided that is operable to control the performance of the fluid pump 100. The control air system 500, is controlled by way of a pump controller 600 that can take a variety of forms, examples of which include a microcontroller or a programmable logic controller (PLC), which could include one or more field programmable gate arrays (FPGA), and/or application-specific integrated circuits (ASIC) for example. The aforementioned elements may be referred to generally herein as programmable elements. While not required, the pump controller 600 can be mounted directly to the fluid pump 100, or alternatively may be a component separate from the fluid pump 100, or may be integrated into a component of the fluid pump 100 such as the pump base 105, pump body 104, or pump head(s) 102. Further details concerning the configuration of an example pump controller 600 are set forth below in the discussion of FIG. 5.

Inputs such as fluid pump 100 flow rate and acceptable pulse values, or pulsation ranges for the fluid pump 100 discharge, can be set in the pump controller 600. In general, the pump controller 600 dictates how each of the connected components, such as the components of the control air system 500, operates. As well, the pump controller 600 controls each side of the fluid pump 100 independently by way of the control air system 500 (see, e.g., Appendix 1 to the 'Related Application' at page 8). The control air system 500 is also controlled by the pump controller 600 to implement overlap, that is, overlapping pump strokes, in the fluid pump 100, by adjusting the amount of time each pump head 102 is under positive pressure, and negative pressure, or vacuum. By automatically adjusting the overlap between pump strokes, the pump controller 600 may, among other things, automatically maintain the fluid pump 100 operation at an acceptable level of pulsation.

It should be noted that while referred to herein as a control air system, the control air system 500 is not limited to use with air and, in other embodiments, can use other gas(es) as an operating fluid, including inert gases such as nitrogen for example. In at least some embodiments, the operating fluid is pressurized clean dry air (CDA). The amount of permissible moisture, or dew point, of the CDA can be dictated by the various components that are employed in the control air system 500, and the desired dew point can be achieved with a variety of different equipment and components. For example, a refrigeration dryer can produce CDA with a dew point in the range of about 37 F to about 50 F. As another example, a desiccant dryer can produce CDA with a dew point in the range of about −40 F to about −100 F. As a final example, a membrane dryer can produce CDA with a dew point in the range of about −40 F to about +35 F.

As indicated in the example of FIG. 4, the control air system 500 includes a variety of components. In general, any of the control air system 500 components that are controlled by the pump controller 600 may be configured so as to report on any aspect of their performance and configuration to the pump controller 600, and such reporting information can be used by the pump controller 600 to automatically adjust the corresponding component(s) of the control air system 500 so as to achieve a desired effect, or effects, with respect to the performance of the control air system 500 and/or the fluid pump 100. As such, the control system 400, which may comprise at least the control air system 500 and pump controller 600, constitutes a closed-loop control system. Moreover, operational parameters for any of the control air system 500 components can be programmed into the pump controller 600 and used as a basis for automatic adjustment of the performance of those components by the pump controller 600.

Further, it will be appreciated that any individual component of the control air system 500, for example, can be configured in a closed-loop feedback arrangement where the pump controller 600 provides a control signal to that component, receives a feedback signal from the component concerning one or more aspects of the configuration and/or performance of that component, and the pump controller 600 can then send an updated control signal to the component based upon the feedback signal received by the pump controller 600 from that component. In other embodiments, any one or more individual components of the control air system 500 may operate in an open-loop configuration where no feedback is provided from the component(s) to the pump controller 600.

It should be noted that while the example of FIG. 4, discussed below, involves the use of CDA as a control medium, the scope of the invention is not limited to CDA, as noted elsewhere herein. Thus, any and all of the components in FIG. 4 can be used with any other suitable control medium, whether in the configuration and arrangement shown in FIG. 4, or in one or more alternative configurations and arrangements. In the particular example of FIG. 4, a CDA supply 502 provides dry air to an electronically controlled regulator 504 that is used to control fluid pump 100 suction and discharge operations, and a standard regulator 506 that is used to control fluid pump 100 suction and discharge operations. The electronically controlled regulator 504 can be automatically controlled by the pump controller 600, while the standard regulator 506 can be manually controlled.

In this example, the electronically controlled regulator 504 and standard regulator 506 are arranged in parallel with respect to each other. With regard to their respective functions, the electronically controlled regulator 504 regulates the CDA pressure to a level set by the pump controller 600. More specifically, the pump controller 600 sends a signal to the electronically controlled regulator 504 to automatically adjust the pressure of the CDA supplied to the fluid pump 100. In general, the CDA pressure affects the output of the fluid pump 100. For example, a relatively higher CDA supply pressure may increase fluid pump 100 output, while a relatively lower CDA supply pressure may result in a decrease in fluid pump 100 output. In at least some embodiments, the electronically controlled regulator 504 reports the pressure of the supplied CDA to the pump controller 600.

The standard regulator 506 can be used to manually regulate the pressure of the CDA that is supplied to the vacuum generator 508. The CDA supply pressure may be set at a fixed value for optimum vacuum generator 508 performance. The vacuum generator 508 operates to cause a fluid pump 100 suction operation by creating a vacuum, or negative pressure, on one side of the diaphragm(s) 200. The vacuum causes a displacement of the diaphragm in the fluid chamber, thereby drawing bulk fluid into the fluid pump 100.

As further indicated in FIG. 4, the control air system 500 may include a first solenoid valve 510 ("A") and a second solenoid valve 512 ("B"). Each of the first solenoid valve 510 and second solenoid valve 512 is electronically, and automatically, controlled by the pump controller 600 and supplied with CDA pressure and vacuum from the electronically controlled regulator 504 and the standard regulator 506. In general, the first solenoid valve 510 and second solenoid valve 512 alternate between supplying a vacuum and positive pressure to the fluid pump 100.

For example, in a first part of a pump cycle, the first solenoid valve 510 can provide positive CDA pressure to one side of the fluid pump 100, while at the same time, the second solenoid valve 512 can provide a vacuum to the other side of the fluid pump 100. In the second part of that pump cycle, the solenoid valve functions are reversed, and the first solenoid valve 510 can provide a vacuum to one side of the fluid pump 100, while at the same time, the second solenoid valve 512 can provide a positive CDA pressure to the other side of the fluid pump 100. Thus, the first solenoid valve 510 and the second solenoid valve 512 cooperatively operate in a complementary fashion to displace the diaphragm.

More particularly, when one of the first solenoid valve 510 and second solenoid valve 512 is switched to vacuum, that solenoid valve causes liquid to be drawn into one side of the pump. When that solenoid valve is switched to pressure, that solenoid valve causes fluid to be pushed out of one side of the fluid pump 100. Thus, the provision of two solenoid valves independently connected with different respective sides of the fluid pump 100 allows for specific control of each chamber of the fluid pump 100. Moreover, by controlling the amount of time each chamber of the fluid pump 100 is in a vacuum state versus being in a positive pressure state, the positive and/or negative pressure cycles can be caused to overlap with each other, resulting in a low pulse flow.

With continued reference to FIG. 4, the control air system 500 further includes a muffler 514 that is connected to the first and second solenoid valves 510/512. In general, the muffler 514 can reduce the volume of the sound that is produced when compressed air is exhausted to the atmosphere by the first and second solenoid valves 510/512, and by the vacuum generator 508.

As further indicated in FIG. 4, a flow control valve 516 is located in the discharge line of each of the first and second solenoid valves 510/512. In some embodiments, the flow control valves 516 take the form of electronically controllable needle valves whose operation can be automatically controlled by the pump controller 600. Any other suitable electronically controllable flow control valve can alternatively be used however and the scope of the invention is not limited to needle valves.

In terms of their operation, the flow control valves 516 regulate the rate at which CDA and vacuum, as applicable, are applied to the two sides of the fluid pump 100, that is, the respective sides of the diaphragm(s) 200. Automatic adjustments to the position of the flow control valves 516, which can be implemented by way of the pump controller 600, allow the pulsation in the fluid flow through the fluid pump 100 to be reduced. The flow control valves 516 thus enable the pump controller 600 to automatically adjust the response time of the pressure change in one side of the fluid pump 100. In some embodiments at least, the flow control valves 516 are able to report their position, that is, the extent to which they are open or closed, to the pump controller 600.

As further indicated in FIG. 4, embodiments of the invention may include a power supply system, one example of which is denoted at 700. In general, the power supply system 700 can supply electrical power to various components of the control air system 500, as well as to the differential pressure measurement device 150, and the pump controller 600. In the particular embodiment disclosed in FIG. 4, the power supply system 700 includes a 24 VDC power supply 702 that provides power to various components of the control air system 500, including the electronically controlled regulator 504, the first solenoid valve 510, the second solenoid valve 512, and the electronically controlled flow control valves 516.

It will be appreciated that power supplies of different types such as AC and DC power supplies, and different voltages, can alternatively be employed. Accordingly, the power supply system 700 is presented by way of example only and is not intended to limit the scope of the invention in any way.

Figure 5:
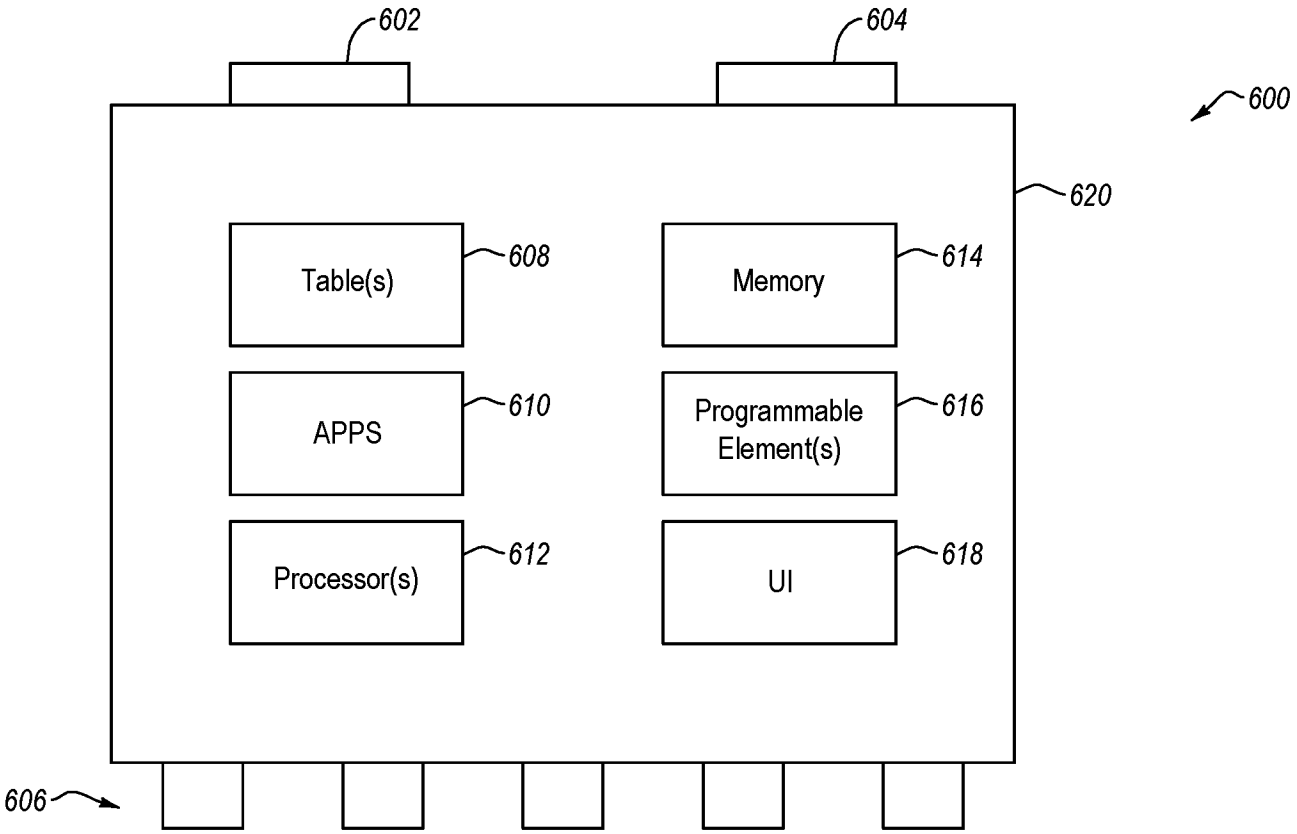
FIG. 5 is directed to an example pump controller.

With reference now to FIG. 5, details are provided concerning an example embodiment of a pump controller, denoted generally at 600. In the illustrated example, the pump controller 600 includes a power connection 602 that can be electrically connected to a power supply, a feedback connection 604 that can be electrically connected to a flow meter transducer, and one or more control connections 606, each of which can be electrically connected to a respective element of the control air system 500.

As well, the pump controller 600 includes a number of other elements specifically relating to its various functions, disclosed elsewhere herein. For example, the illustrated pump controller 600 can include one or more lookup tables 608, applications 610, one or more processors 612, memory 614 which can include RAM and/or ROM, and any type of non-volatile memory. The pump controller 600 may further include one or more programmable elements 616, and a user interface (UI) 618 by way of which a user can operate and program the pump controller 600. Finally, the pump controller 600 can include a housing/mount 620 that houses the various elements of the pump controller 600 and which may be mountable to various structures, including elements of a fluid pump.

D. Operational Aspects of Some Embodiments

With continued attention to FIGS. 1-5, further details are provided concerning operational aspects of some example embodiments. Initially, the pump controller 600 can be pre-programmed, or reprogrammed, depending upon the circumstances, with a variety of inputs that can then be used by the pump controller 600 as reference points for making adjustments to one or more elements of the control air system 500 based on feedback received from one or more of the control air system 500, the differential pressure measurement device 150, and/or the fluid pump 100. In one particular embodiment, the inputs used by the pump controller 600 include a minimum acceptable flow rate, or range of flow rates, of the fluid pump 100, and an acceptable pulse value, or pulsation range, for the fluid pump 100 discharge. The pulse value, or pulsation range, can be expressed in terms of a maximum acceptable change in the fluid discharge pressure of the fluid pump 100 that occurs during the time when a first chamber of the fluid pump transitions from a vacuum state to a pressure state and the second chamber of the fluid pump transitions from a pressure state to a vacuum state (see, e.g., Appendix 1 to the 'Related Application' at page 8). Of course, other inputs can also be programmed into the pump controller 600, and the scope of the invention is not limited to the aforementioned examples.

In more detail, the pump controller 600 can control the operation of a component based on input received not from the controlled component, but from one or more other components. To this end, the pump controller 600 can include one or more tables, equations, or maps for example, that map particular input values received by the pump controller 600 with corresponding output control signals that will be generated by the pump controller 600 and transmitted to various controlled components. The controlled components may include, for example, any one or more of the electronically controlled regulator 504, the first solenoid valve 510, the second solenoid valve 512, and the flow control valves 516.

By way of illustration, the table or map can correlate various fluid pump 100 discharge flow rates, measured and reported by the differential pressure measurement device 150, with particular positions of one or both of the flow control valves 516. Thus, for example, if the reported flow rate from the fluid pump 100 is unacceptably low/high and/or the pulse value of the fluid pump 100 discharge is unacceptably high, the pump controller 600 can perform a lookup process using the table or map and determine the output control signal that must be transmitted to the flow control valve(s) 516 in order to achieve the desired flow rate, and the output control signal(s) that must be transmitted to one or more of the electronically controlled regulator 504 and/or the first and second solenoid valves 510/512 in order to achieve the desired pulse value. Once the appropriate control signals are determined, the pump controller 600 can then send the control signals to the flow control valve 516 and/or the electronically controlled regulator 504 and/or the first and second solenoid valves 510/512, as appropriate. In some embodiments at least, one, some, or all of the flow control valves 516, electronically controlled regulator 504 and/or the first and second solenoid valves 510/512, may send an acknowledgement to the pump controller 600 that the control signal has been received and acted upon. In other embodiments, no acknowledgement signal is sent by the controlled component(s) to the pump controller 600. The same general process discussed in this illustration can be applied as well to any other component controlled by the pump controller 600.

In the preceding illustrative example, the pump controller 600 controls a component based upon input received from one or more other components but does not use input from the controlled component itself. In other embodiments however, the pump controller 600 can control a component based on input received from the controlled component itself, and with or without input received from one or more other components.

By way of illustration, a flow control valve 516 can report its position, that is, the extent to which the flow control valve 516 is open, to the pump controller 600 and the pump controller 600 can compare the received input with data in the table to determine whether an adjustment should be made to the position of the flow control valve 516. Where an adjustment is required, such as when the input received from the controlled component, the flow control valve 516 in this example, does not fall in a desired range, which can be specified in a map or table in the pump controller 600, the pump controller 600 can then send a corresponding control signal, which also may be specified in the map or table, to the flow control valve 516 to adjust the configuration and/or performance of the flow control valve 516. Similar processes can be implemented in connection with any other device, or combination of devices, controlled by the pump controller 600, including any one or more of the electronically controlled regulator 504, the first solenoid valve 510, the second solenoid valve 512, and the flow control valves 516.

Although this disclosure has been described in terms of certain embodiments, other embodiments apparent to those of ordinary skill in the art are also within the scope of this disclosure. Accordingly, the scope of the disclosure is intended to be defined only by the claims which follow.

What is claimed is:

1. A fluid system, comprising:

an air-operated fluid pump, comprising:

a pump body that includes a fluid inlet connection and a fluid outlet connection, and the pump body further including a first control fluid connection and a second control fluid connection;

a pump head connected to the pump body; and a diaphragm positioned between the pump head and the pump body such that the first control fluid connection is in fluid communication with a first side of the diaphragm, and the second control fluid connection is in fluid communication with a second side of the diaphragm;

a control air system operably connected with the air-operated fluid pump by way of the first control fluid connection and the second control fluid connection; and a pump controller operably connected with one or more components of the control air system, wherein the pump controller is configured to automatically control the operation of the air-operated fluid pump by way of the control air system, and wherein air-operated fluid pump parameters automatically controlled by the pump controller include a discharge flow rate of the fluid pump, and a pulsation value associated with the discharge of the air-operated fluid pump.

2. The fluid system as recited in claim 1, wherein pump body, pump head, and diaphragm are each constructed of any of: perfluoroalkoxy (PFA), polytetrafluoroethylene (PTFE), a fluoroelastomer (FKM), or a perfluoroelastomer (FFKM).

3. The fluid system as recited in claim 1, wherein the pump controller is operable to automatically control any one or more of the following parameters: positive pressure to the air-operated fluid pump; vacuum pressure to the air-operated fluid pump; cycle time of the air-operated fluid pump; and, phase overlap of the air-operated fluid pump.

4. The fluid system as recited in claim 1, further comprising a differential pressure measurement device configured and arranged to receive part of the discharge of the air-operated fluid pump, and the differential pressure measurement device is operable to transmit a feedback signal to the pump controller.

5. The fluid system as recited in claim 1, wherein the pump controller, control air system, and the air-operated fluid pump are arranged in a closed-loop control configuration.

6. The fluid system as recited in claim 1, wherein the pump controller is integrated together with the air-operated fluid pump to form a single unit.

7. The fluid system as recited in claim 1, wherein the pump controller is programmable to include a range of discharge flow rates of the air-operated fluid pump, and a range of pulsation values of the air-operated fluid pump.

8. A fluid system comprising:

an air-operated fluid pump, comprising:

a pump body that includes a fluid inlet connection and a fluid outlet connection, and the pump body further including a first control fluid connection and a second control fluid connection;

a pump head connected to the pump body; and a diaphragm positioned between the pump head and the pump body such that the first control fluid connection is in fluid communication with a first side of the diaphragm, and the second control fluid connection is in fluid communication with a second side of the diaphragm;

a control air system operably connected with the air-operated fluid pump by way of the first control fluid connection and the second control fluid connection, and the control air system comprising:

an air supply;

an electronically controlled regulator and a manually controlled regulator arranged in parallel with each other and in fluid communication with the air supply, and the electronically controlled regulator is configured to receive and act upon control signals from the pump controller;

a vacuum generator downstream of, and in fluid communication with, the manually controlled regulator;

first and second solenoid valves arranged in parallel with each other, each of the first and second solenoid valves is in fluid communication with both the electronically controlled regulator and the vacuum generator, and each of the solenoid valves configured to receive and act upon control signals from the pump controller; and first and second flow control valves, each of the flow control valves configured to receive and act upon control signals from the pump controller, the first flow control valve being located downstream of, and in fluid communication with, the first solenoid valve, and the second flow control valve being located downstream of, and in fluid communication with, the second solenoid valve, and an output of the first flow control valve being in fluid communication with a first side of the air-operated fluid pump, and an output of the second flow control valve being in fluid communication with a second side of the air-operated fluid pump; and a pump controller operably connected with one or more components of the control air system, wherein the pump controller is operable to automatically control the operation of the air-operated fluid pump by way of the control air system, and wherein air-operated fluid pump parameters automatically controlled by the pump controller include: a discharge flow rate of the fluid pump; and, a pulsation value associated with the discharge of the air-operated fluid pump.

9. The fluid system as recited in claim 1, wherein the pump controller is configured to receive and act upon feedback received from a differential pressure measurement device that is configured for fluid communication with the air-operated fluid pump.

10. The fluid system as recited in claim 8, wherein the first and second flow control valves each comprise an electronically controllable needle valve.

11. The fluid system as recited in claim 1, wherein the pump controller is operable to control phase overlap associated with suction and discharge operations of the air-operated fluid pump.

12. The fluid system as recited in claim 1, wherein the pump controller is programmable to include values of one or more air-operated fluid pump operating parameters.

13. The fluid system as recited in claim 1, wherein the pump controller is operable to automatically control an amount of time that the pump head is under a positive pressure, and an amount of time that the pump head is under a negative pressure.

14. The fluid system as recited in claim 1, wherein the pump controller comprises:

a power connection;

a plurality of control signal connections connected to respective components of the control air system;

a feedback signal connection connected to a differential pressure measurement device that is in fluid communication with a discharge side of the air-operated fluid pump;

one or more programmable elements; and one or more processors connected with the programmable elements and the feedback signal connection, wherein when the programmable elements are programmed for automatic control of the air-operated fluid pump, the pump controller is operable to automatically control operation of the air-operated fluid pump through a closed loop system, and wherein the pump controller is further operable to control a pulse value associated with operation of the air-operated fluid pump.

15. The fluid system as recited in claim 1, wherein the air-operated fluid pump includes a first chamber in fluid communication with the first side of the diaphragm, and second chamber in fluid communication with the second side of the diaphragm, and wherein:

in a first operational state, the first chamber is positively pressurized and the second chamber is in a vacuum state;

in a second operational state, both the first chamber and the second chamber are positively pressurized; and in a third operational state, the second chamber is positively pressurized and the first chamber is in a vacuum state.

16. The fluid system as recited in claim 8, wherein the pump body, pump head, and diaphragm are each constructed of any of: perfluoroalkoxy (PFA), polytetrafluoroethylene (PTFE), a fluoroelastomer (FKM), or a perfluoroelastomer (FFKM).

17. The fluid system as recited in claim 8, wherein the pump controller is operable to automatically control an amount of time that the pump head is under a positive pressure, and an amount of time that the pump head is under a negative pressure.

18. The fluid system as recited in claim 8, wherein the air-operated fluid pump includes a first chamber in fluid communication with the first side of the diaphragm, and second chamber in fluid communication with the second side of the diaphragm, and wherein:

in a first operational state, the first chamber is positively pressurized and the second chamber is in a vacuum state;

in a second operational state, both the first chamber and the second chamber are positively pressurized; and in a third operational state, the first chamber is in a vacuum state, and the second chamber is positively pressurized.

* * * * *